US007384172B1

(12) United States Patent
Desfosses

(10) Patent No.: US 7,384,172 B1
(45) Date of Patent: Jun. 10, 2008

(54) SPORTS BALL LAMP HAVING THEME BASE

(76) Inventor: Rene Claude Desfosses, 136 Mountain Cir. SE., Airdrie, AB (CA) T4A 1X1

( * ) Notice: Subject to any disclaimer, the term of this patent is extended or adjusted under 35 U.S.C. 154(b) by 8 days.

(21) Appl. No.: 11/488,103

(22) Filed: Jul. 18, 2006

(51) Int. Cl.
*F21V 17/02* (2006.01)

(52) U.S. Cl. ..... 362/282; 362/322; 362/361; 362/363; 362/414; 362/806; 446/485

(58) Field of Classification Search ..... 362/282, 362/283, 321–322, 360, 361, 410, 414, 806, 362/809, 363; 446/485; 473/570; D26/128
See application file for complete search history.

(56) References Cited

U.S. PATENT DOCUMENTS 1,902,991 A * 3/1933 Cardon ..... 362/283
2,307,977 A * 1/1943 Wellman ..... 362/283
2,491,448 A * 12/1949 Hillebrand et al. ..... 362/283

* cited by examiner

*Primary Examiner*—Stephen F Husar
(74) *Attorney, Agent, or Firm*—Red Gallagher

(57) ABSTRACT

A portable lamp for demonstration of a sports theme comprises: a) a base; b) a supporting member projecting from the base having an upper end portion; and, c) a generally spherical light source carrying lamp head, carried by the upper end portion of the upright shaft, having an outer segment and a diametrically smaller inner segment, said segments generally semi-spherical and having opposite end portions pivotally attached. Then the segments can be rotated closed to generally form a sphere, or alternatively rotated so that the sphere then has an open segment and the light source therein can radiate light therethrough. Light emitted through the open segment can be controlled by varying a width of said open segment. Most preferably the supporting member comprises an upright shaft capable of manipulation so that its upper end portion can be positioned at a selected angular orientation with respect to the base.

16 Claims, 1 Drawing Sheet

SPORTS BALL LAMP HAVING THEME BASE

FIELD OF THE INVENTION

This invention relates to a lamp having an adjustable spherical lamp head for regulating the dispersion and intensity of light. More particularly this invention relates to a lamp having a spherical head having a segment which when opened increases the dispersion and intensity of emitted light. Because of its spherical head the lamp is readily adapted to a sports or other theme wherein the sphere is decorated as a ball used in a particular sport.

BACKGROUND OF THE INVENTION

Today's consumers are more demanding and discriminating than they have been in the past. Generally speaking personally designed and custom built and installed mood lighting equipment is prohibitively expensive. However, there is a large market for portable lamps which facilitate custom personalized lighting options. A mood can be readily instigated with a colored lamp filter or lens on what otherwise would be a common lamp. This market is largely unsatisfied. Individuals who are avid enthusiasts of a sport in which they participate, or even only regularly spectate, frequently maintain a room decorated with that sports theme. There is a demand for a lamp which demonstrates an individual's participation and passion for a particular activity or sport. There is also need for a lamp which, by projecting colored light can readily change the mood in a room.

Another aspect of the invention comprises differently focusing light projected from a lamp. The most apparent need for this would be to more intensely focus emitted light on reading material less than a few feet away. Other aspects of this same idea include passing the light through a distorted lens to thereby project intense areas or dark ribbons on surrounding room walls and ceiling. Such a lamp would dramatically affect the decor and mood in a relatively dimly lit room. But presently there is no such portable lamp available. There is a need for an inexpensive portable light distorting and focusing lamp.

OBJECTS OF THE INVENTION

It is an object of this invention to disclose a portable lamp which demonstrates its owner's participation in, and passion for a particular sport. It is an object of this invention to disclose a lamp which controls light dispersion and focusing. It is yet a further object of this invention to disclose a mood enhancing lamp which employs a colored filter or a transparent light distorting lens to project a selected color or pattern onto surrounding room surfaces.

One aspect of this invention provides for a portable lamp for demonstration of a sports theme comprises: a) a base; b) a supporting member projecting from the base having an upper end portion; and, c) a generally spherical light source carrying lamp head, carried by the upper end portion of the upright shaft, having an outer segment and a diametrically smaller inner segment, said segments generally semi-spherical and having opposite end portions pivotally attached. Then the segments can be rotated closed to generally form a sphere, or alternatively rotated so that the sphere then has an open segment and the light source therein can radiate light therethrough. Light emitted through the open segment can be controlled by varying a width of said open segment. Most preferably the supporting member comprises an upright shaft capable of manipulation so that its upper end portion can be positioned at a selected angular orientation with respect to the base.

In a preferred aspect of this invention the lamp head is decorated to resemble a ball used in a particular sport chosen and used to thematically decorate the lamp. The base of the lamp may also be shaped and decorated to resemble an object associated with the particular sport chosen.

Various other objects, advantages and features of this invention will become apparent to those skilled in the art from the following description in conjunction with the accompanying drawings.

FIGURES OF THE INVENTION

Figure 1:
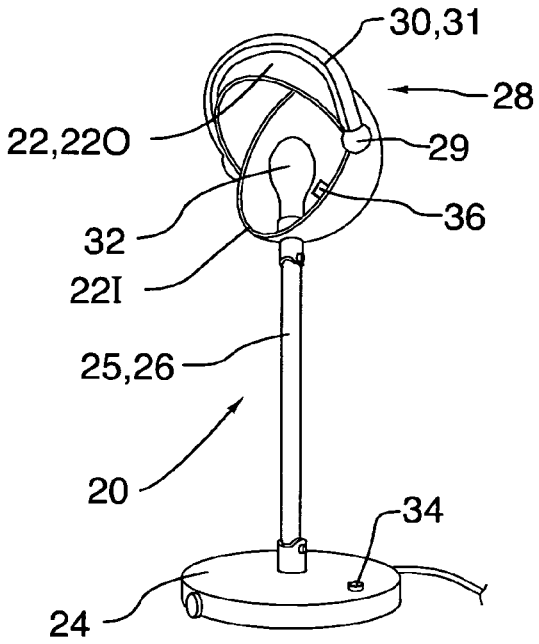
FIG. 1 is a perspective view of a spherical lamp having a segment thereof in an open position.

The following is a discussion and description of the preferred specific embodiments of this invention, such being made with reference to the drawings, wherein the same reference numerals are used to indicate the same or similar parts and/or structure. It should be noted that such discussion and description is not meant to unduly limit the scope of the invention.

DESCRIPTION OF THE INVENTION

Turning now to the drawings and more particularly to FIG. 1 we have a spherical lamp 20 having a segment 22 thereof in an open position. Most generally a portable lamp 20 for demonstration of a sports theme comprises: a) a base 24; b) a supporting member 25 projecting from the base 24 having an upper end portion; c) a generally spherical light source carrying lamp head 28, carried by the upper end portion of the upright shaft 26, having an outer segment 22O and a diametrically smaller inner segment 22I, said segments 22 generally semi-spherical and having opposite end portions pivotally 29 attached. Then the moveable segment 22 can be rotated to a closed position to generally form a sphere 21, or alternatively rotated so that the sphere 21 then has an open segment and the light source 32 therein can radiate light therethrough. Light emitted through the open segment can be controlled by varying a width of said open segment.

Within this specification a sphere, generally spherical, semi-spherical and segment/s thereof are intended and defined to include a football shape (not shown). It should be further noted that segment is intended and defined to mean a segment of a hollow sphere and not a true segment as in an orange segment.

The inner segment 22I is supported and carried by the upright shaft 26. Most preferably the supporting member 25 is an upright shaft 26 capable of manipulation so that its upper end portion can be positioned at a selected angular orientation with respect to the base 24. For example the upright shaft 26 might be a gooseneck 27 which when bent would remain in the bent position. The inner segment 22I, through the pivots 29 carries the outer segment 22O. In a preferred aspect of the invention a rotation control member 30 is fixably connected to opposite end portions of one of the segments 22, for respective rotation with respect to the other segment 22. In the most preferred aspect of the invention the rotation control member 30 comprises a generally semi-circular insulated handle 31 having opposite end portions which are rigidly connected to the inner segment 22I so that the size of the segment opening can be varied by rotatably moving the handle 31 around the sphere 21. In yet another aspect of this invention the base further comprises a light intensity control 34. A switch 36 is provided to automatically turn off the lamp 32 when the inner segment 22I and outer segment 22O are closed.

Figure 2:
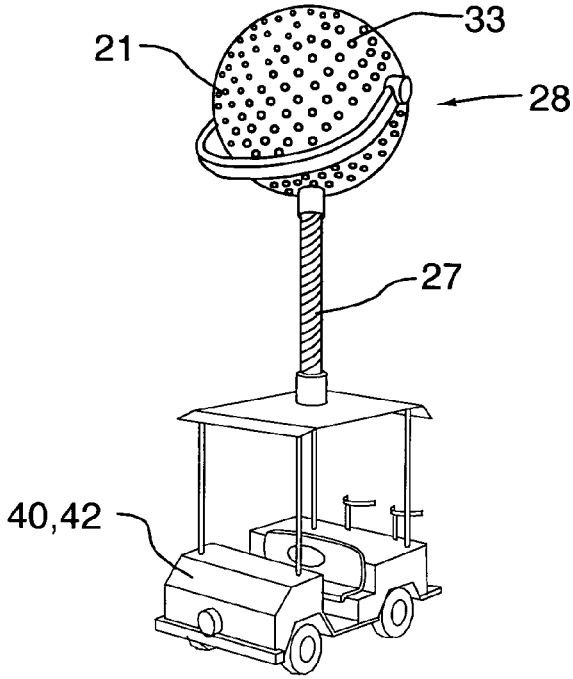
FIG. 2 is a perspective view of a portable lamp similar to that shown in FIG. 1 but having the light source carrying head and base configured to demonstrate involvement with a particular activity. The movable segment of the sphere is shown in a closed position.

FIG. 2 is a perspective view of a portable lamp 20 similar to that shown in FIG. 1 but having the light source carrying head 28 and base 24 configured to demonstrate involvement with a particular activity. The movable segment 22O is shown in a closed position. The light source carrying head 28 is decorated to resemble a ball 33 used in a particular sport chosen and used to thematically decorate the lamp 20. The base 24 also may be shaped and decorated to resemble an object 40 associated with the particular sport chosen. In FIG. 2 the light source carrying head 28 is decorated to resemble a golf ball 33 and the base 24 is shaped and decorated to resemble a golf cart 42.

Figure 3:
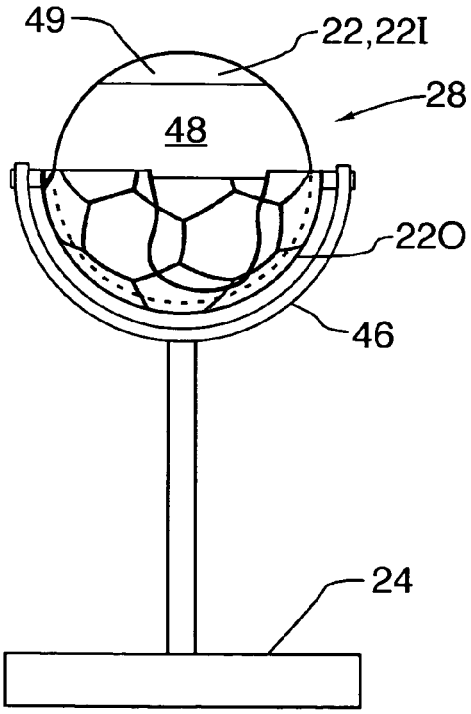
FIG. 3 is a perspective view of a lamp similar to that shown in FIG. 1 but wherein the sphere is carried by a yolk so that both segments of the sphere can pivot therein. The inner segment further comprises an adjacent generally transparent semi-spherical segment shaped lens so that when the lens is pivoted so that it is not covered by the outer segment emitted light passes through the lens.
Figure 4:
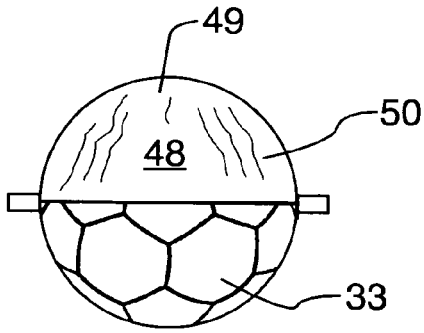
FIG. 4 is a perspective view of the inner segment and adjacent lens of the lamp head shown in FIG. 3.

FIG. 3 is a perspective view of a lamp 20 similar to that shown in FIG. 1 but wherein the lamp head 28 is carried by a yolk 46 so that both inner and outer segments 22 can pivot therein. In FIG. 3 the lower portion of the inner segment 22I is covered by the outer segment 22O. FIG. 4 is a perspective view of the inner segment 22I and adjacent lens 48 of the lamp head 28 shown in FIG. 3. If the inner generally semi-spherical segment 22I further comprises an adjacent generally transparent semi-spherical segment shaped lens 48, then said inner segment 22I and said outer segment 22O are able to be relatively positioned so that light radiates light through the lens 48; or alternatively, so that the lens 48 is beneath the opaque outer segment 22O and the lamp head 28 appears wholly opaque. In another aspect of this invention the supporting member 25 comprises an upright shaft 26 and said shaft 26 is capable of manipulation so that its upper end portion can be positioned at a selected angular orientation with respect to the base 24, and the lens 48 has a central convex portion 49 to focus the light for reading.

For other aspects of this invention most preferably the supporting member 25 comprises a yolk 46 which is centrally carried. The lens 48 may be selectively tinted to emit a colored light selected to influence the mood of an individual using the lamp 20. Alternatively, the opaque portions of the lamp head 28 may be decorated to resemble a ball 33 used in a particular sport and the lens 48 may then be tinted to the team color of a professional team playing the sport using the type of decorated ball 33. In yet another aspect of the invention the lens 48 may be transparent with and semi-opaque portions 50 so that light emitted through the lens 48 produces a pattern on immediate surroundings.

While the invention has been described with preferred specific embodiments thereof, it will be understood that this description is intended to illustrate and not to limit the scope of the invention, which is defined by the following claims.

I claim:

1. A portable lamp for demonstration of a sports theme comprises:

a) a base;

b) a supporting member projecting from the base having an upper end portion; and, c) a generally spherical light source carrying lamp head, carried by the upper end portion of the supporting member, having an outer segment and a diametrically smaller inner segment, said segments generally semi-spherical and having opposite end portions pivotally attached;

so that the segments can be rotated closed to generally form a sphere, or alternatively rotated so that the sphere then has an open segment and the light source therein can radiate light therethrough;

and so that light emitted through the open segment can be controlled by varying a width of said open segment.

2. A portable lamp as in claim 1 wherein the supporting member comprises an upright shaft capable of manipulation so that its upper end portion can be positioned at a selected angular orientation with respect to the base.

3. A portable lamp as in claim 1 wherein the inner segment is supported and carried by the upright shaft and wherein the inner segment, through the pivots carries the outer segment.

4. A portable lamp as in claim 2 further comprising a rotation control member fixably connected to opposite end portions of one of the segments, for respective rotation with respect to the other segment.

5. A portable lamp as in claim 4 wherein the rotation control member comprises a generally semi-circular insulated handle having opposite end portions which are rigidly connected to the inner segment so that the size of the segment opening can be varied by rotatably moving the handle around the sphere.

6. A portable lamp as in claim 5 wherein the base further comprises a light intensity control and wherein a switch is provided to automatically turn off the lamp when the inner segment and outer segment are closed.

7. A portable lamp as in claim 1 wherein the lamp head is decorated to resemble a ball used in a particular sport chosen and used to thematically decorate the lamp.

8. A portable lamp as in claim 7 wherein the base is shaped and decorated to resemble an object associated with the particular sport chosen.

9. A portable lamp as in claim 8 wherein the lamp head decorated to resemble a golf ball and the base is shaped and decorated to resemble a golf cart.

10. A portable lamp as in claim 1 wherein the inner generally semi-spherical segment further comprises an adjacent generally transparent semi-spherical segment shaped lens, said inner and outer segments able to be relatively positioned so that the light source therein radiates light through the lens; or alternatively, so that the lens is beneath the opaque outer segment and the lamp head appears wholly opaque.

11. A portable lamp as in claim 10 wherein the supporting member comprises an upright shaft projecting from the base, said shaft capable of manipulation so that its upper end portion can be positioned at a selected angular orientation with respect to the base.

12. A portable lamp as in claim 11 wherein the lens has a central convex portion to focus the light for reading.

13. A portable lamp as in claim 10 wherein the supporting member comprises a yolk which is centrally carried.

14. A portable lamp as in claim 10 wherein the lens is tinted to emit a colored light said color selected to influence the mood of an individual using the lamp.

15. A portable lamp as in claim 10 wherein the opaque portions of the lamp head are decorated to resemble a ball used in a particular sport and wherein the lens is tinted to the team color of a professional team playing the sport using the type of decorated ball.

16. A portable lamp as in claim 10 wherein the lens is transparent and semi-opaque so that light emitted through the lens produces a pattern on immediate surroundings.

* * * * *